US012644063B2

(12) United States Patent
Castille et al.

(10) Patent No.: US 12,644,063 B2
(45) Date of Patent: Jun. 2, 2026

(54) MOBILE OFFSHORE PRODUCTION AND PROCESSING UNITUTILIZING PRODUCED NATURAL GAS GENERATING POWER, HYDROGEN, CARBON, AND/OR HYDROCARBON LIQUIDS

(71) Applicant: Modular MOPU, LLC, Houston, TX (US)

(72) Inventors: Craig Castille, Houston, TX (US); Robert Hoff, Houston, TX (US); Venkatesh Bhat, Tomball, TX (US)

(73) Assignee: Modular MOPU, LLC, Houston, TX (US)

( * ) Notice: Subject to any disclaimer, the term of this patent is extended or adjusted under 35 U.S.C. 154(b) by 0 days.

(21) Appl. No.: 19/352,960

(22) Filed: Oct. 8, 2025

(65) Prior Publication Data

US 2026/0103648 A1 Apr. 16, 2026

Related U.S. Application Data

(60) Provisional application No. 63/707,073, filed on Oct. 14, 2024.

(51) Int. Cl.
*C10L 1/04* (2006.01)
*E21B 19/00* (2006.01)
(Continued)

(52) U.S. Cl.
CPC ..... *C10L 1/04* (2013.01); *E21B 43/01* (2013.01); *E21B 43/34* (2013.01); *E21B 49/087* (2013.01);
(Continued)

(58) Field of Classification Search
CPC .. C10L 1/04; C10L 2270/026; C10L 2270/04; E21B 43/01; E21B 43/34; E21B 49/087; E21B 19/004
See application file for complete search history.

(56) References Cited

U.S. PATENT DOCUMENTS 8,403,058 B2 3/2013 Nadarajah et al.
8,689,881 B2 4/2014 Nadarajah et al.
(Continued)

FOREIGN PATENT DOCUMENTS

CA 2464970 A1 10/2005
CN 109638828 A 4/2019
(Continued)

*Primary Examiner* — James G Sayre

(74) *Attorney, Agent, or Firm* — ePatentManager.com; Guerry L. Grune

(57) ABSTRACT

Methods, systems and devices that utilize a mobile offshore drilling unit (MODU) with other integrated equipment, hereinafter a mobile offshore production unit (MOPU) or a traditional floating production unit (FPU) to produce oil and natural gas from an oil and gas containing subsea geological formation are described. When the MOPU/FPU consumes all produced natural gas in one or more processes onsite to produce products selected from power, liquid petroleum products, hydrogen gas, solid carbon, and combinations thereof, then the production unit is transformed into a Modular MOPU™. Some produced natural gas is used to generate electricity for normal facility operations and additional natural gas consumed to generate electricity for various 4th-phase processes or used as feedstock for the production of value added products in processing equipment such as pyrolysis units, and/or gas-to-liquids units. Maximizing consumption of produced natural gas onsite, optimizes oil production without flaring, and without any export pipelines.

7 Claims, 7 Drawing Sheets

(51) Int. Cl.
*E21B 43/01* (2006.01)
*E21B 43/34* (2006.01)
*E21B 49/08* (2006.01)

(52) U.S. Cl.
CPC ..... *C10L 2270/026* (2013.01); *C10L 2270/04* (2013.01); *E21B 19/004* (2013.01)

(56) References Cited

U.S. PATENT DOCUMENTS

| | | | | |
|---|---|---|---|---|
| 8,864,420 | B2 | 10/2014 | Foo et al. | |
| 8,882,891 | B1 | 11/2014 | Williams | |
| 2011/0081586 | A1* | 4/2011 | McAlister | H01M 8/186 429/422 |
| 2019/0078281 | A1* | 3/2019 | Cotaya, III | E02B 17/027 |
| 2024/0384187 | A1 | 11/2024 | Subamat et al. | |

FOREIGN PATENT DOCUMENTS

| | | | | |
|---|---|---|---|---|
| CN | 112226259 | B | 12/2021 | |
| CN | 113982532 | A | 1/2022 | |
| IN | 201614027949 | A | 4/2017 | |
| KR | 20160036851 | A | 4/2016 | |
| KR | 20240023394 | A | 2/2024 | |
| NO | 347733 | B1 | 3/2024 | |
| WO | WO-2012097925 | A1 * | 7/2012 | B63G 8/08 |

* cited by examiner

MOBILE OFFSHORE PRODUCTION AND PROCESSING UNITUTILIZING PRODUCED NATURAL GAS GENERATING POWER, HYDROGEN, CARBON, AND/OR HYDROCARBON LIQUIDS

PRIORITY

This application is a nonprovisional conversion of and claims priority to U.S. Provisional Application 63/707,073 filed Oct. 14, 2024, entitled "OFFSHORE PRODUCTION AND PROCESSING UNIT FOR OIL PRODUCTION WITHOUT FLARING AND WITHOUT OIL & GAS FLOWLINES OR EXPORT PIPELINES BY CONSUMING PRODUCED NATURAL GAS TO GENERATE POWER, HYDROGEN, CARBON AND/OR HYDROCARBON LIQUID", the entirety of which is incorporated by reference herein.

BACKGROUND

The present disclosure relates to methods and apparatus used in offshore oil and gas exploration, development, and production. Whereas production through novel combinations of equipment and processes can be accomplished without flaring produced gas, without installing subsea flowlines to an existing host facility and without installing export pipelines to an onshore location.

Background

Traditional and New Definitions

Floating Production Unit (FPU)—Is a traditional facility designed to provide accommodations for personnel to operate 3-phase (oil-gas-water) production equipment together with all other equipment used for power generation, stability, station keeping and oil & gas export.

Mobile Offshore Drilling Unit (MODU)—Is a traditional facility designed to provide accommodations for personnel who operate the specialized drilling equipment and other equipment used for power generation, stability and station keeping. MODUs are used to explore and to develop offshore oil and gas fields and can be bottom founded (jack-up) or floating (drillship or semi-submersible) facilities. A MODU may perform short term well testing where the produced gas is flared.

Mobile Offshore Production Unit (MOPU)—Is a traditional MODU facility that has been modified to provide long term production operations by removing certain drilling equipment and adding 3-phase (oil-gas-water) production equipment. Oil and gas are exported via pipelines, tankers and in some cases where permissible, excess gas is flared.

Modular Offshore Production and Processing Unit (aka Modular MOPU™ or Modular MOP$^2$U™)—Is a novel concept where additional modules are added to a traditional FPU or traditional MOPU that allows it to consume all the natural gas required to maintain oil production at levels that exceed commercial thresholds. The additional modules consist of natural gas power generation and one or more 4th-Phase processes which consume additional power and/or natural gas. The additional natural gas consumption is provided by natural gas turbine generators and 4th-Phase processes such as but not limited to; i) Electrolysis, ii) Gas-to-Liquids (GTL), iii) Methane Pyrolysis or iv) Artificial Intelligence (AI)/High-Performance Computing (HPC)/Mining Operations. The additional products; hydrogen, liquid petroleum products, carbon and HPC/Mining services can be safely used onboard or exported for sale. The ability to consume large quantities of natural gas will eliminate natural gas flaring, direct methane discharge (venting), natural gas/oil export pipelines, and flowlines in cases where production is processed on and exported from an existing nearby facility. In addition, the schedule from discovery to first oil can be shortened by eliminating export pipelines, eliminating delays with boarding a host platform controlled by others and by repurposing idle MODUs. As used herein, mining operations may include data mining opeartions such as, for example, cryptocurrency mining and other compute-intensive data processing workloads.

Electrolysis—is to electrically split water into oxygen and hydrogen which in some embodiments may be powered by onboard-generated electricity produced on the platform. Existing electrolysis systems such as Alkaline and Proton Exchange Membrane "PEM", are available for integration on the MOPU when there is a desire to generate and export hydrogen. The electrolyzer splits water in two partial reactions that take place at the two electrodes—cathode (−) and anode (+)—in the electrolysis cell. In practice, electrolyzers consist of several interconnected electrolysis cells, also called stacks. When voltage is applied, hydrogen is produced at the cathode and oxygen at the anode. Hydrogen is captured for use in power generation onsite or is transported and consumed offsite. The oxygen may be utilized in other processes or safely vented.

Gas-to-Liquids (GTL)—is a catalytic process which involves the chemical conversion of natural gas (primarily methane) into "synthetic" liquid hydrocarbons—such as aviation fuel (SAF), diesel and naphtha. GTL is an appropriate option in natural gas exploitation, with the main end products being useful as low emission transportation fuels with value added attributes. These refined products can be safely segregated and transported on existing oil tankers needed for crude oil transport.

Natural Gas or Methane Pyrolysis—is the process of breaking down methane, the primary component of natural gas, into hydrogen gas and solid carbon by applying high temperatures in the absence of oxygen, essentially thermally decomposing the methane molecule to produce these two products; this process is often used as a method to produce hydrogen with minimal carbon dioxide emissions by capturing the solid carbon byproduct. The heat required for thermal decomposition can be achieved via combustion, plasma, or microwave. Onsite pyrolysis of natural gas is both energy intensive and requires a natural gas feed stock. As a result, larger amounts of natural gas can be consumed onsite, where the hydrogen production is sufficient to power the pyrolysis process and to operate the facility, which in turn results in a carbon negative operation capable of zero emissions. The carbon produced is a commercial product with value added potential which is easily transported in bulk from the MOPU as a liquid or solid.

As used herein, "turquoise hydrogen" refers to hydrogen produced through methane pyrolysis, wherein natural gas is thermally decomposed in the absence of oxygen to produce hydrogen gas and solid carbon; and "yellow hydrogen" refers to hydrogen produced through electrolysis powered by onboard-generated electricity generated on the platform. These classifications may be used herein when describing example hydrogen production pathways implemented on the Modular MOPU.

Offshore oil and gas production has historically relied on a 3-phase production process which separates oil, gas, and water. Typically, oil is exported via pipeline(s) or via tankers, natural gas is consumed for power, may be recycled for improved production excess gas is either sold via export pipeline, flared when and where regulations allow or it is reinjected into a subsurface reservoir. Flaring is a waste of valuable resources, contrary to the principle of conservation of resources, and may be detrimental to the environment through unnecessary emissions. Reinjection of gas into a subsurface reservoir is both costly and does not produce revenue. Produced water is either discharged into the ocean within strict guidelines or reinjected into the producing reservoir for pressure maintenance.

Development of oil and gas reserves relies on economical methods to export products. Large fields can shoulder the financial burden of a dedicated Floating Production Unit (FPU), infield gathering lines and separate oil and gas export lines. Near infrastructure exploration and development is desirable so new reserves can be tied back to and processed onboard the existing FPU. On many occasions, the parties exploring and developing an oil and gas field are not owners in the existing FPU, and as such they can be delayed, constrained or prevented entirely from accessing the FPU. In some cases, the reserves are considered stranded and not timely developed or written off by the owner. Having the ability to develop resources without relying solely on access to the existing FPU and/or oil and gas export pipelines will provide operators more confidence in their ability to successfully develop discoveries.

Production platforms used offshore are either bottom founded or floating. Floating production platforms can be stationary (moored or tethered to the seafloor) or dynamically positioned. Mobile offshore drilling units (MODU) are a type of maritime vessel used to drill for oil and gas reserves held in geological formations beneath the seabed. Successful wells having sufficient reserves can later be completed for production by the MODU and hooked up for production on the production platform. MODUs are vital for offshore exploration and development in areas where oil and gas are found far from shorelines. MODUs come in various forms, including jack-up rigs, semi-submersible rigs, and drillships, each designed for different water depths and operational needs. While their specific designs vary, all MODUs share essential components that enable them to perform their functions safely and efficiently.

The primary components of a MODU include the drilling equipment, well control equipment, mud processing equipment, deck structure, power generation systems, station keeping equipment, stabilization mechanisms, living quarters and safety systems. The derrick and drill string are the core elements of the drilling equipment, enabling the drilling of holes into the seabed. The deck structure typically holds additional equipment and storage areas. Semi-submersibles and drillships rely on dynamic positioning systems or anchors to remain on the station, while jack-up rigs use retractable legs that extend to the seabed for stability in shallower waters.

MODUs are designed to be mobile, making it possible to move them to various locations for exploration or development operations. Once positioned over a drilling site, the unit is stabilized and secured. The drilling process involves the lowering of the drill string and the gradual penetration of the seabed. MODUs are equipped with blowout preventers (BOPs), critical safety devices that prevent uncontrolled release of oil or gas during drilling. The rig's power generation systems supply energy to all operational processes, including drilling, lighting, and crew accommodations.

Overall, MODUs are crucial for tapping into offshore oil and gas reserves, particularly in regions where there is existing infrastructure required for development or in regions where large accumulations capable of supporting infrastructure installation are possible. Their mobility, combined with sophisticated stabilization and safety mechanisms, allows for efficient and safe drilling in a range of oceanic conditions.

SUMMARY

Once successful wells are drilled and completed in one or more subsurface reservoirs, the wells'production is predicated on the ability to flow to a FPU or a mobile offshore drilling unit which is equipped to produce oil and natural gas, hereinafter a Mobil Offshore Production Unit "MOPU". The power generation equipment used in production will dictate the fuel type, such as diesel or natural gas, used to generate power. Excess natural gas is typically exported but may be flared if regulations allow it.

Offshore exploration and development using MODU's is cyclical and the business of "Drilling Contractors" has proven to be very risky, a poor return on capital and has resulted in numerous bankruptcies. In the past, Drilling Contractors have managed the cyclical nature of the business by buying leases and performing their own exploration work when down cycles occurred. This risk mitigation technique was halted to reduce the perception and fear of competing with their clients. Therefore, some embodiments comprise providing Drilling Contractors with an alternative use of their MODUs which provide longer term contracts that are not tied to exploration or development drilling operations. The conversion of a MODU into a MOPU that can achieve commercially viable production quantities is a strategy that should improve any Drilling Contractor's financial performance and reduce the risk of bankruptcy.

Some embodiments provide a method comprising the use of a conventional FPU or MOPU to consume all of the produced natural gas for power generation and to increase power demand in one or more additional processes to produce one or more value added products that can be used onsite or safely exported without a pipeline. Processes for natural gas consumption and conversion may include, but are not limited to: i) Gas-to-Liquids (GTL) where natural gas is converted to aviation fuel, diesel, methanol, naphtha or other transportable petroleum products, ii) the production of hydrogen gas which can be consumed onsite for power while lowering emissions or exported in pressurized transport tanks, hydrogen laden liquids or hydrogen tankers, iii) the production of various forms of carbon which can be gathered and exported in bulk as a solid or liquid, and iv) AI/HPC/Mining Operations. These "4th Phase" processes can be used alone or in combination, wherein the one or more processes are added to a typical FPU or MOPU having traditional 3-Phase production equipment, to perform offshore production and processing operations.

Some embodiments provide a mobile offshore production and processing unit, hereinafter a "Modular MOPU" that can consume all of the natural gas produced by a traditional FPU or MOPU. The Modular MOPU consumes all of the produced natural gas in one or more processes to produce power and to produce one or more products including, but not limited to, liquid petroleum products (GTL), hydrogen gas, carbon, and combinations thereof.

Some embodiments of the Modular MOPU reduce the carbon footprint of oil and gas operations by consuming natural gas in lieu of flaring or burning diesel fuel for power, onsite generation of hydrogen together with its consumption for power or its export to onshore locations, producing solid carbon or producing clean synthetic fuels such as diesel and other environmentally advantaged liquid petroleum products.

Some embodiments provide carbon footprint reductions by converting existing FPUs or MODUs into Modular MOPUs whereby certain manufacturing and construction emissions are eliminated and existing equipment such as but not limited to triplex pumps used in drilling operations can be used in water injection, BOP control lines can be used for SS tree controls, riser tensioning systems used in drilling can be used to provide a top tensioned production riser, bulk systems can be used for solid carbon storage, reverse osmosis systems can be used for electrolyzer feed or boiler makeup water, diesel engines can be converted to dual fuel for natural gas consumption and power generation and dynamically positioning systems can be used for station keeping.

Some embodiments may provide additional value by reducing capital expenditures and environmental impact by allowing commercially viable oil production during extended reservoir testing that validate the resource potential without additional delineation drilling. The number and placement of wells may be optimized without unnecessary drilling, thus reducing cost, emissions, discharges, and project risk.

More specifically, the present disclosure describes a modular offshore production and processing system (Modular MOPU), comprising: a floating or bottom-founded platform; a 3-phase separation unit for oil, gas, and water; a modular pyrolysis reactor configured to convert natural gas into hydrogen and solid carbon; a modular electrolyzer system configured to convert water into hydrogen and oxygen using onboard-generated electricity; a gas-to-liquids (GTL) unit configured to convert natural gas into liquid petroleum products; a provisioned zone configured for high-performance computing (HPC) or mining operations utilizing onsite power and cooling; one or more diesel or dual-fuel generators and additional gas turbine generators configured to consume natural gas and/or hydrogen for power generation; and a control system configured to optimize power distribution and product output.

More specifically, the platform is a Modular MOPU, a converted mobile offshore drilling unit (MODU), or floating production unit (FPU).

Here, the modular components are configured for temporary or permanent installation.

In some embodiments, the hydrogen and carbon products can be stored onboard in dedicated tanks or bulk systems.

The system also can include a pyrolysis reactor device(s) configured for offshore use, comprising: a multi-zone chamber configured to thermally decompose methane in the absence of oxygen; a heating system powered by onboard electricity; a filtration system configured to separate solid carbon from hydrogen gas; a carbon storage unit and a hydrogen system configured for onsite fuel or compression with storage. As used herein, "turquoise hydrogen" refers to hydrogen produced through methane pyrolysis, wherein natural gas is thermally decomposed in the absence of oxygen to produce hydrogen gas and solid carbon, as described herein. "Yellow hydrogen" refers to hydrogen produced through electrolysis powered by electricity generated from natural gas combustion or other onboard power sources. Both turquoise and yellow hydrogen production methods are contemplated for use with the modular offshore production and processing system described herein.

In addition, the system can include an electrolyzer unit(s), configured for offshore use and comprised of one or more designs: such as a proton exchange membrane (PEM) stack; a water purification system configured to supply deionized water; a power interface configured to receive alternating or direct current from onboard generators; a hydrogen storage tank and an oxygen discharge system.

Here the system may also include a gas-to-liquids (GTL) conversion unit, configured for offshore use and comprising: a feedstock conditioning module; a catalytic reactor configured to convert methane into one or more liquid petroleum products such as diesel, methanol, or jet fuel; a heat source powered by onboard combustion or electricity; a liquid product storage system wherein an electrolyzer unit may also provide oxygen for said GTL process and production of hydrogen.

A method for using a MODU also exists that augments and/or utilizes a new or existing hydrocarbon production unit to produce oil and natural gas from an oil and gas containing subsea geological formation; and consuming all produced natural gas in one or more processes onsite to produce one or more products selected from electrical energy, liquid petroleum products, hydrogen gas, carbon, and combinations thereof, wherein one or more processes are performed by utilizing energy obtained from offshore oil and gas production and processing equipment added to a new or existing MODU.

Unlike conventional processes, the produced gas will be consumed or transformed onsite with the purpose of eliminating subsea export pipelines and eliminating any need to access a separate processing facility via one or more flowlines and control systems.

Here the method may also be used for generating electricity via combustion of at least a portion of produced natural gas; and pyrolyzing a second portion of produced natural gas wherein natural gas production utilizes at least a portion of generated electricity, wherein pyrolysis of produced natural gas forms carbon and hydrogen gas.

Here electricity is generated by a gas turbine electrical generator and/or a dual-fuel electrical generator.

The method can also include compressing hydrogen gas; and storing the compressed hydrogen gas in high-pressure cylinders for transport.

In yet another embodiment, consuming at least a portion of the hydrogen gas produced by the pyrolysis and/or electrolysis process as fuel in a gas turbine for power generation is useful.

For cases where the use of electric power produced onsite for use in HPC or digital mining activities and providing cooling systems available onsite that provides for required operations.

In another embodiment, generating electricity via combustion of a first portion of the produced natural gas to generate power for an electrolyzer to convert liquid water into hydrogen gas and oxygen gas and to supply power for other facility and oil production processing needs while any remaining natural gas can be processed into other products.

These methods also includes compressing the hydrogen gas; and storing the compressed hydrogen gas in a storage vessel.

In yet a further embodiment consuming at least a portion of the hydrogen gas produced by the electrolysis process as fuel in a gas turbine that produces power.

These methods also provide oxygen gas that can be used in the pyrolysis process and GTL process or discharged directly to the atmosphere.

These methods generating electricity via combustion of a first portion of produced natural gas; using natural gas as feedstock for the gas-to-liquids (GTL) process;

heating the natural gas feedstock sufficiently by electricity or combustion to form a liquified petroleum product; and storing the liquified petroleum product in a storage vessel.

Here consuming all of the produced natural gas in the one or more processes of the Modular MOPU enables oil and natural gas production in the absence of flaring produced natural gas and in an absence of a pipeline for exporting produced natural gas to market.

Additional requirements to transport produced fluids, oil, gas and water directly for a subsea well to a 3rd party facility via subsea flowlines for processing is eliminated, thereby eliminating the cost of flowlines, control lines and 3rd party processing and other fees.

Another important embodiment Modular MOPU can perform a well test operation and all of the natural gas produced during the well test operation is consumed in the one or more processes performed by the mobile offshore production and processing unit.

Where a Modular MOPU is derived from the conversion of a mobile offshore drilling unit (MODU), various drilling systems can be used for production operations.

Here, an existing bulk transfer system on a MODU is used to handle carbon produced by the mobile offshore production and processing unit.

Also there exists triplex pumps on a MODU used in reservoir pressure maintenance by the Modular MOPU.

In yet another embodiment, existing subsea control lines are used to operate subsea wells and associated safety systems.

Here the existing riser tensioning system is used to support and manage a top tension production and utility riser necessary to produce oil and gas from the subsea wells.

In yet another embodiment, the existing derrick system is used to run and retrieve the top tension production and utility riser and store it on location when moving offsite due to impending weather or shipyard work.

It is also possible to utilize existing reverse osmosis units for water consumption in the electrolyzer.

When an existing MODU is transformed into a Modular MOPU with additional offshore production and processing equipment, it may be used on a temporary or permanent basis for use in short term well testing, extended well testing, interim production operations, and full field development (long term production).

It is also possible to repurpose a MODU for use as a Modular MOPU with additional power generation and 4th phase products, such as carbon (including carbon black), hydrogen gas, and/or liquid petroleum products as well as recycling, desalination, and purification of water.

In addition, conversion of an existing FPU, MOPU or MODU into a Modular MOPU reduces go forward carbon footprint for manufacturing and construction, wherein conversion of an existing FPU, MOPU or MODU into a Modular MOPU enables extended well testing that reduces carbon footprint and capital expenditures required for additional exploration/delineation drilling operations by testing reservoirs to ascertain boundaries and thereby reducing drilling time required for development.

DETAILED DESCRIPTION

Figure 1A:
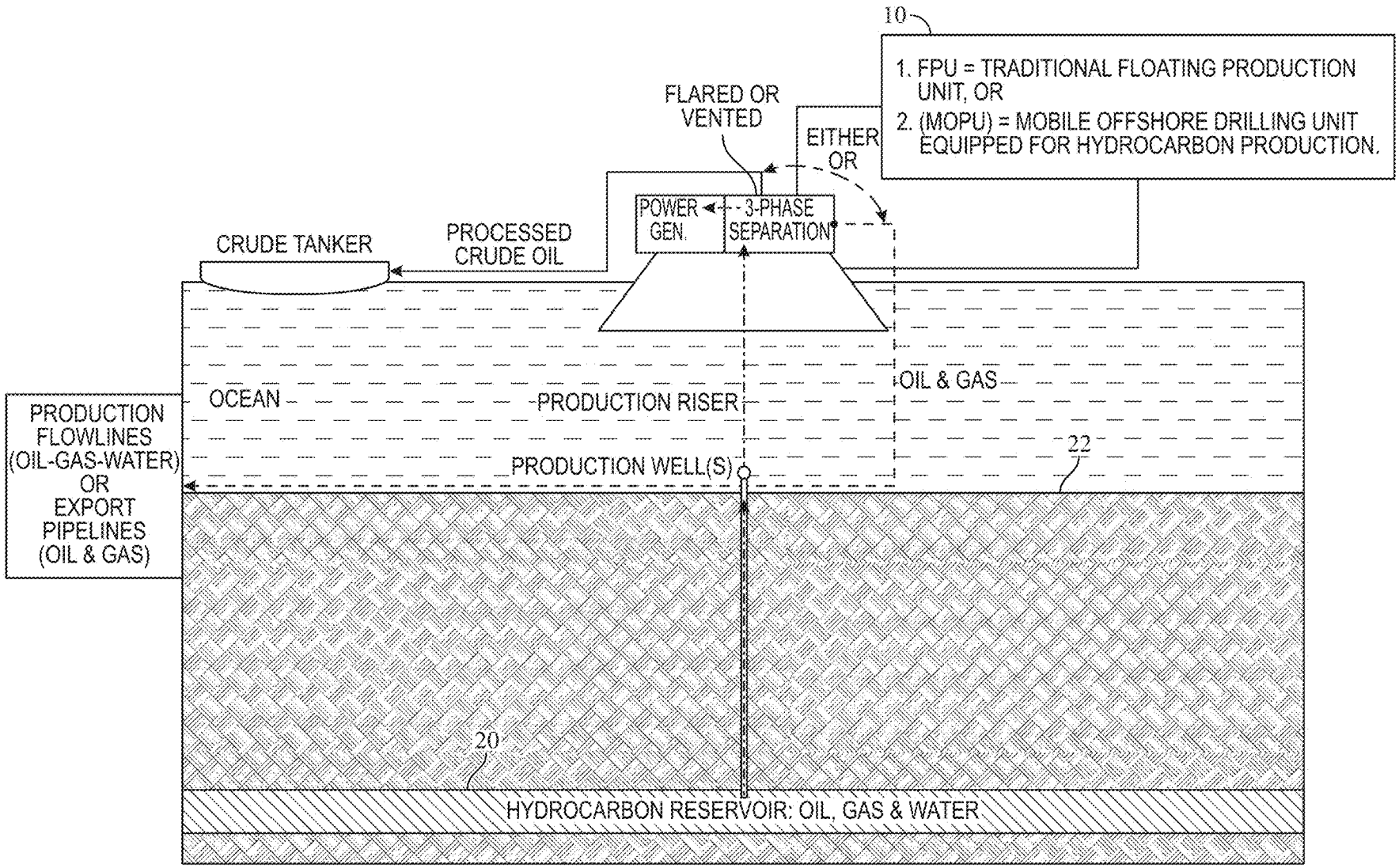
FIG. 1A is a schematic diagram of a traditional floating production unit (FPU) or mobile offshore production unit (MOPU).

Some embodiments provide a method comprising using a FPU or MOPU to produce oil and natural gas from a subsurface reservoir and consuming all of the produced natural gas to generate power and in one or more processes to produce one or more products including, but not limited to, liquid petroleum products (GTL), hydrogen gas (from electrolysis of water or pyrolysis of natural gas), carbon (from pyrolysis of natural gas) and combinations thereof, wherein the one or more processes are performed onboard a mobile offshore production and processing unit that has been transformed from a FPU or a MODU.

The term "natural gas" refers to a gas extracted from a hydrocarbon-containing geological formation where the natural gas may be dissolved in the oil (associated gas) or free gas which exists as a gas in the reservoir. The natural gas contains one or more hydrocarbon components, which usually includes mostly methane ($CH_4$) along with lesser amounts of ethane ($C_2H_6$), propane ($C_3H_8$), and/or butane ($C_4H_{10}$). Natural gas may also contain amounts of carbon dioxide ($CO_2$), hydrogen sulfide ($H_2S$), and/or water vapor ($H_2O$). The exact composition of natural gas may vary from formation to formation and may vary over time.

Embodiments provide a reliable 4-phase processing system that eliminates dependence on a pipeline or flaring during production operations which could range from: i) short term well testing for cleanup and to measure well performance, ii) extended well testing to measure reservoir performance, size and to optimize future well placement, iii) interim production operations to improve early cash flow and project economics and iv) full offshore field development. The term "4-phase" refers to the usual production process of separating oil, gas, and water (i.e., three phases) plus the generation of a useful product from the consumption of natural gas (i.e., the 4th phase) on site. The 4th phase generates a product stream that is separate and distinct from the traditional 3-phase separation of oil, gas, and water, and is therefore referred to as the fourth phase.

Embodiments of the processing system may be constructed as modular components or sub-systems. The modular construction of the processing systems facilitate installation of the processing systems on existing mobile offshore drilling units (MODUs). Furthermore, the modular construction of the processing system facilitates incremental scaling of the processing system to meet a wide range of production volumes. In one example, modular processing systems or units may be added to a MODU thus transforming it temporarily or permanently to a Modular MOPU which is capable of producing tens of thousands barrels of oil per day (BOPD) with the exact amount predicated by the reservoirs'Gas:Oil Ratio (GOR), and the added power generation and 4th Phase processing units that product carbon (including carbon black), hydrogen gas, oxygen gas, and/or liquid petroleum products which are capable of utilizing the associated gas without flaring and without access to an export pipeline. Rather, the modular processing unit may consume the associated gas as fuel and/or convert the gas into a commercially valuable product.

In some embodiments, some of the produced natural gas is converted into either (1) hydrogen gas, (2) liquid petroleum products (GTL), or (3) solid carbon. Each of these products have commercial value and typically reduce environmental impacts and emissions associated with oil and gas production. Importantly, embodiments of the processing system may enable a Modular MOPU to be put in service even where flaring is prohibited and there is no access to a gas pipeline. It is a technical benefit of the processing system embodiments that produced natural gas may be consumed onsite to produce a commercially valuable transportable product in the absence of flaring and without requiring access to an export pipeline.

Some embodiments include generation of electricity via combustion of all or a portion of the produced natural gas using existing diesel engines converted to dual fuel engines capable of consuming diesel and natural gas. Electricity may also be generated by a gas turbine electrical generator (42) using natural gas and/or hydrogen produced onsite. Electric generation from the various equipment will be optimized for improved oil production and natural gas/hydrogen consumption while safely managing facility operations.

In some embodiments, the processing system may include a gas turbine electrical generator that consumes some or all of the produced natural gas and hydrogen while generating electricity that can be used to operate other processes, such as GTL, electrolysis, pyrolysis or AI/HPC/mining system(s). Optionally, the gas turbine electrical generator may be used in combination with a diesel-powered electrical generator, which may be converted to or used as a dual-fuel (such as diesel and/or natural gas) electrical generator. Accordingly, a unit of the dual-fuel electrical generator may use a smaller amount of the produced natural gas than a unit of the gas turbine electrical generator. Combinations of one or more gas turbine electrical generator units and one or more dual-fuel electrical generators may be selected to optimize oil production and match the power demand of operations. However, some embodiments may utilize dual-fuel electrical generators without the use of a gas turbine electrical generator. In fact, diesel generators and/or dual-fuel electrical generators that are existing components of the MODU may be partially or fully utilized by the Modular MOPU, including the modification of an existing diesel generator to be operational as a dual-fuel electrical generator in order to utilize a portion of the produced natural gas for the production of electricity.

Some embodiments of the processing system may include a power inverter to change direct current output to alternating current or a rectifier to convert alternating current to direct current. For example, a pyrolysis system may be designed to operate on alternating or direct current, whereas a PEM electrolyzer stack may be designed to operate on direct current. An appropriate combination of AC and DC electrical power may be provided depending upon the mix of equipment to be used, including pump motors, etc.

In some embodiments, the method may include generating electricity via combustion of a first portion of the produced natural gas and pyrolyzing a second portion of the produced natural gas using some or all of the generated electricity, wherein the pyrolyzing of the produced natural gas forms solid carbon and hydrogen gas.

In some embodiments, the processing system includes a pyrolysis system that consumes produced natural gas ($CH_4$) and produces solid carbon (C) and hydrogen gas ($H_2$). For example, the first zone of a pyrolysis chamber may use electricity to superheat the produced natural gas in a flameless manner in the absence of oxygen so that there are no oxidation reactions within the system. In a second zone of the pyrolysis chamber, the heat breaks the bonds between the carbon and hydrogen atoms in the natural gas molecules. In a third zone, the carbon atoms are allowed to cluster together to form various grades of carbon. In a fourth zone, the carbon and hydrogen exit the pyrolysis chamber, and the carbon is separated/filtered from the hydrogen gas. Accordingly, a carbon product and a clean hydrogen gas product may be produced from the natural gas. The hydrogen gas may be used as fuel onsite or prepared for transport, and the carbon product may be gathered in bulk systems for transport to shore.

Alternatively natural gas pyrolysis can occur by thermally heating natural gas feedstock in a chamber isolated from oxygen when natural gas/hydrogen combustion is used as the heat source. Separation/filtration of the solid carbon from the hydrogen is required for final utilization and/or transportation.

In some embodiments, the method may include generating electricity via combustion of a first portion of the produced natural gas and using electrolysis to convert liquid water into hydrogen gas and oxygen gas using some or all of the generated electricity. For example, the processing system may include one or more electrolyzer systems that consume electricity to convert water ($H_2O$) into hydrogen gas ($H_2$) and oxygen gas ($O_2$). The electrolyzer system may include any number of proton exchange membrane (PEM) or other types of electrolyzers. For example, a PEM electrolyzer may include a PEM electrolyzer stack formed by repeating units of anode, proton exchange membrane, cathode, and bipolar plate separator. In one optional configuration, a membrane electrode assembly (MEA) provides the proton exchange membrane already coated with anode and cathode electrocatalyst layers. In a further optional configuration, a gas diffusion layer (also referred to as a current collector) may be positioned against one or both sides of the MEA to support the transport of liquids and/or gases to/from the electrode surface as well as provide an electronic conductor between the MEA and the bipolar plates. The water is preferably a deionized water or demineralized water, which is typically generated on the Modular MOPU, or it may be shipped to the Modular MOPU. The oxygen gas may be consumed in some local process, produced as a product, or merely discharged into the atmosphere. The hydrogen gas is preferably utilized as fuel in gas turbine power generation or stored in one or more forms such as but not limited to compressed hydrogen gas or liquid tanks. However, hydrogen gas may also be flared with no formation of $CO_2$, CO, or $NO_x$ since the hydrogen gas does not contain carbon or nitrogen. Some PEM electrolyzer systems may be provided as a modular system referred to as a "modular hydrogen platform" (MHP).

The hydrogen gas produced by either a pyrolysis system or an electrolyzer system may be utilized in various manners. In the first option, some or all of the hydrogen gas may be collected and stored in one or more hydrogen storage tanks. The hydrogen storage tanks may subsequently be shipped as a commercial product. One or more compressors may be used to store the hydrogen in the hydrogen storage tanks, such as high-pressure cylinders, as either a pressurized hydrogen gas or a liquified hydrogen. In a second option, some or all of the hydrogen gas may be utilized by mixing it into the produced natural gas to fuel a gas turbine and lower emissions. In a third option, some or all of the hydrogen gas may be flared. While flaring produced natural gas may be prohibited due to the production of carbon dioxide, carbon monoxide, and the like, flaring hydrogen would result in the production of harmless water vapor.

In some embodiments, the method may include generating electricity via combustion of a first portion of the produced natural gas, conditioning the natural gas as necessary for the GTL process and heating the natural gas feedstock by generating heat from natural gas combustion or electricity to form one or more high value and environmentally advantaged liquified petroleum products, which can be stored separately from the crude oil produced or if necessary blended into the crude oil for transport. The liquified petroleum products can be efficiently stored and shipped to market using an existing oil tanker, thus eliminating the need to flare or export natural gas via pipeline.

Some embodiments provide a method of converting or transforming a MODU into a Modular MOPU to temporarily or permanently produce oil and gas. In one example, the Modular MOPU may process and consume all of the natural gas produced during a short term or extended well testing operation without flaring while enabling sufficient oil production to pay for part or all of the well testing operation. In another example, the Modular MOPU may process and consume the natural gas produced during long term production operations without flaring and without the need for any gas export line. In general, the Modular MOPU can be used for the two extreme cases (short and long) as well as for extended well testing and interim production operations. Embodiments may provide the technical benefit of enabling a Modular MOPU to produce oil and gas without access to a gas pipeline. In a preferred option, none of the produced gas is flared or transferred to a separate processing facility via subsea flowline or pipeline, rather it is utilized in the Modular MOPU operations to produce value added products and to lower emissions.

FIG. 1A is a schematic diagram of a floating production unit (FPU) or mobile offshore production unit (MOPU) 10. The FPU/MOPU 10 is positioned over an oil and gas containing geological formation 20 below a seabed 22. Optionally, the FPU/MOPU 10 may float on the water or may be supported from the seabed 22. The FPU/MOPU 10 may include drilling equipment and requires 3-phase production equipment allowing the FPU/MOPU 10 to produce oil, gas, and water from the geological formation 20. However, where flaring of natural gas is prohibited and a natural gas pipeline is not accessible, the traditional FPU/MOPU 10 is unable to perform production operations.

Figure 1B:
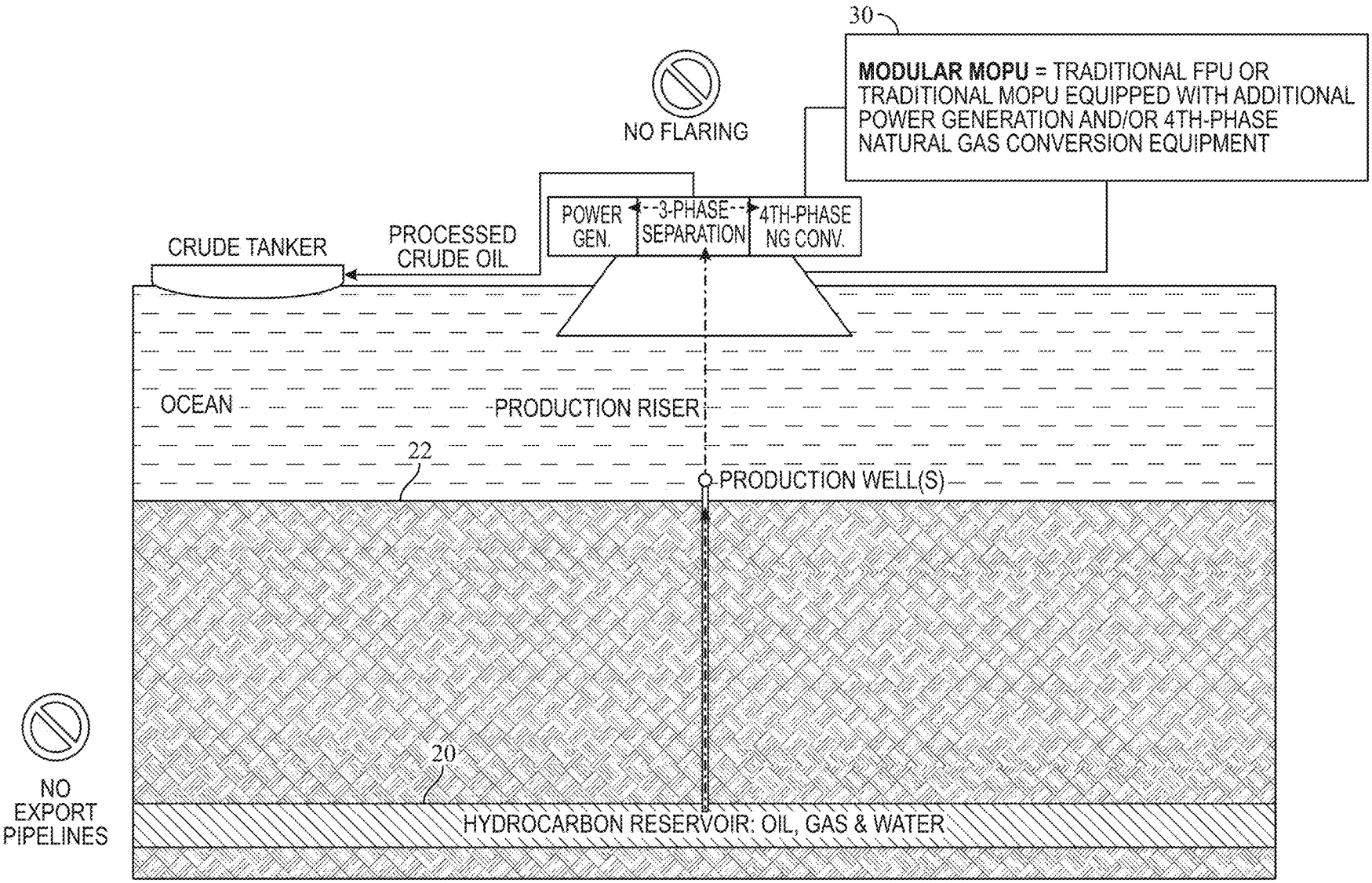
FIG. 1B is a schematic diagram of a Modular MOPU where the 4th Phase processing equipment is added and flaring, flowlines and export pipelines are eliminated or unavailable.

FIG. 1B is a schematic diagram of a Modular MOPU 30 which addresses the problem of excess natural gas production without flaring, flowlines, or export pipelines. This will enable the Modular MOPU 30 to perform well testing operations for sufficient periods of time to add technical and commercial value or to produce one or more oil reservoirs in commercial quantities as either an interim production solution (while other equipment are procured and installed for a permanent solution) or as the permanent solution for the oil field. Modular MOPU 30 operations are characterized by consuming all of the natural gas onsite and producing one or more commercially valuable products.

Figure 2:
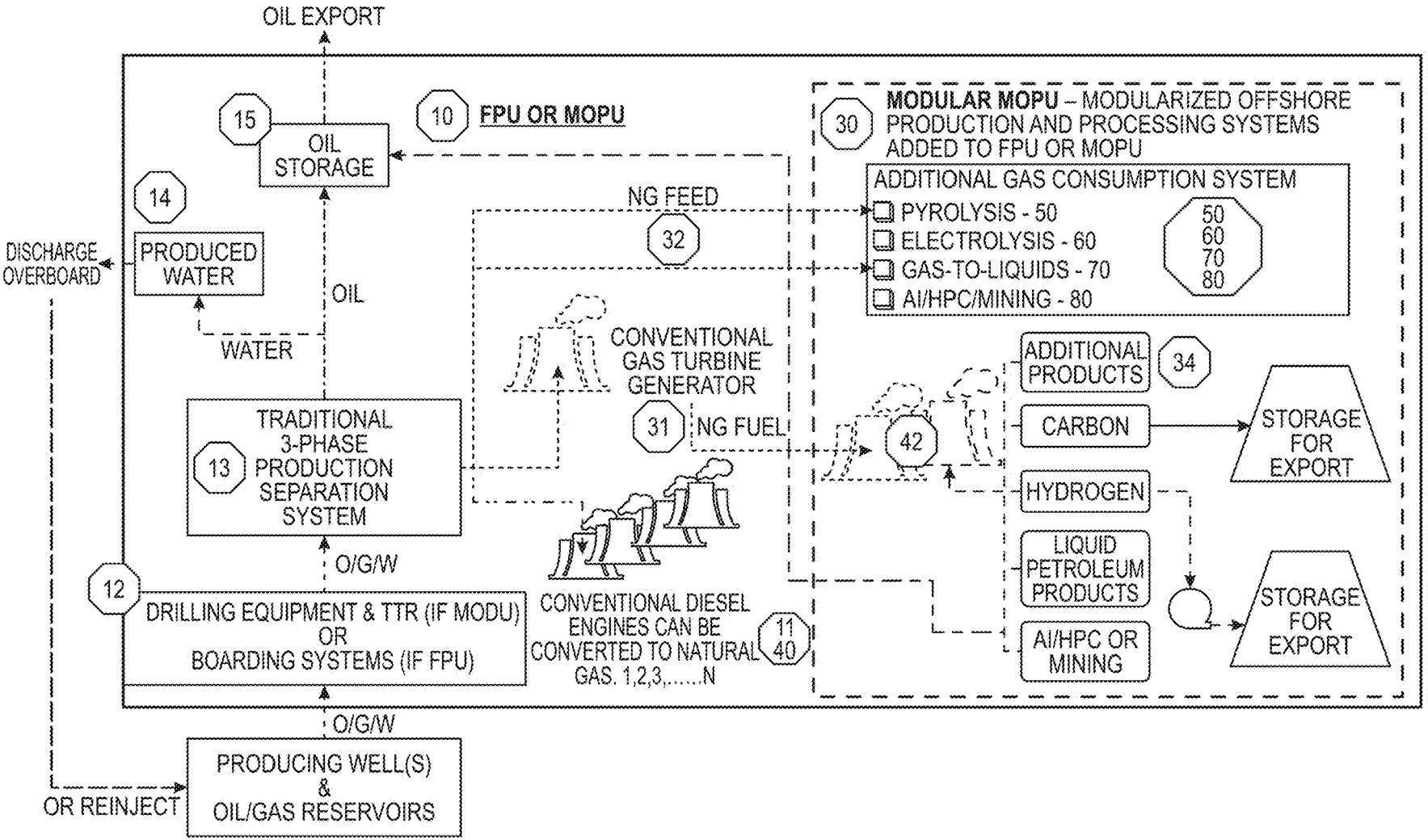
FIG. 2 is a block diagram of a Modular MOPU that includes several 4th Phase processes and additional power generation for sustainable economically viable production.

FIG. 2 is a block diagram of the FPU or MOPU 10 that has been modified to include a modular offshore production and processing unit (Modular MOPU) 30. The FPU or MOPU 10 is shown in greater detail as including one or more diesel-powered electrical generators 11 which may be converted to dual fuel electric generators (diesel or natural gas) 40 as notated in FIG. 2 through FIG. 6 that provide electricity to support the operation of drilling equipment 12. The drilling equipment 12 extracts a combination of oil, gas, and water from the producing well(s) and/or oil/gas reservoirs and provides the combination to a 3-phase (oil, gas, and water) production separation system 13.

Accordingly, the water fraction is output to a water handling system 14 and the oil fraction is output to an oil storage vessel or tank 15 as the primary product of the FPU or MOPU. The natural gas fraction, received from the FPU or MOPU 10 at point 31 (the junction point) is output to the modular offshore production and processing unit (Modular MOPU) 30 for use in the gas turbine electrical generators 42, or as a natural gas feed 32 which is used in the additional gas consumption system(s). At a high level, the Modular MOPU 30 includes one or more gas consumption systems (50,60, 70,80) and additional products produced onsite 34. Without limitation, the gas consumption system may include one or more dual-fuel diesel electrical generators 40 (also shown as number 11), one or more conventional gas turbine electrical generators 42, one or more pyrolysis systems 50 and/or one or more gas-to-liquid systems 70. Electricity generated by gas turbine electric generators 42 may be further used by one or more electrolyzers to produce hydrogen gas using electrolysis 60 and/or one or more AI/HPC/digital mining systems (aka Bitcoin or other digital currency mining or offshore data centers) 80. Without limitation, the Modular MOPU may produce one or more 4th phase products, such as carbon (including carbon black), hydrogen gas, and/or liquid petroleum products. Optionally, some or all of the electrical generators that consume some or all of the produced natural gas may be units already installed on the FPU or MOPU and may be units included in the modular MOPU system that are added to the FPU or MOPU.

Figure 3:
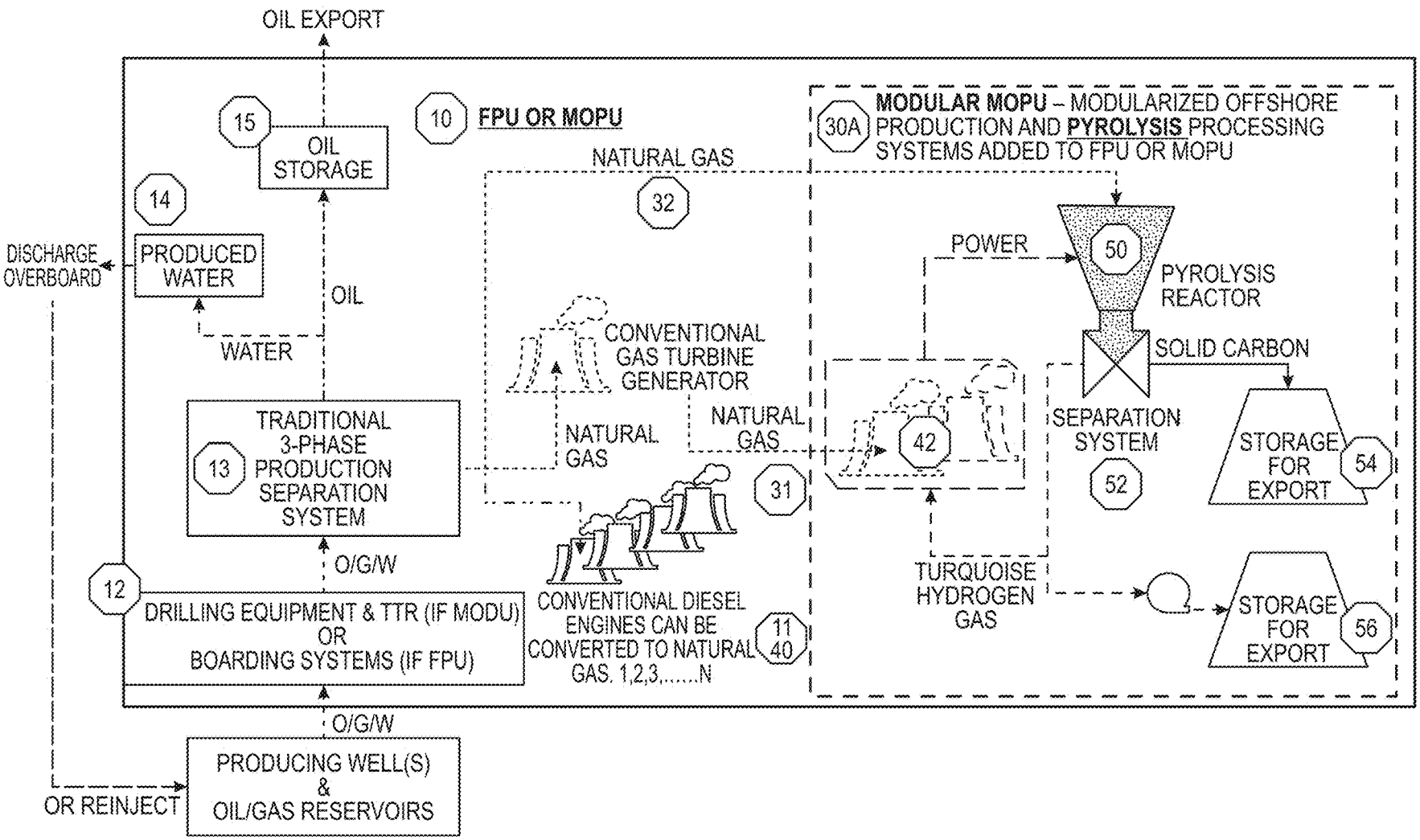
FIG. 3 is a block diagram of a Modular MOPU according to a first embodiment whereby additional power is added for a natural gas pyrolysis process that produces hydrogen and solid carbon.

FIG. 3 is a block diagram of a Modular MOPU 30A system according to a first embodiment. A stream of a produced natural gas is received from the FPU or MOPU 10 at point 31. In this embodiment, a first portion of the gas may be supplied to one or more dual-fuel electrical generators 40, which may be a diesel-powered electrical generator that has been converted to use diesel and/or natural gas. Furthermore, these dual-fuel electrical generators 40 may be diesel-powered electrical generators existing on the FPU or MOPU that are converted to accept diesel and/or natural gas. A second portion of the gas is being supplied to additional gas turbine electrical generators 42. Although the dual-fuel electrical generators 40 and the gas turbine electrical generators 42 both produce electricity, each unit of the dual-fuel electrical generators (40) may use a smaller amount of the produced natural gas than a unit of the gas turbine electrical generator. Combinations of one or more gas turbine electrical generator units and one or more dual-fuel electrical generators may be selected to match the amount of produced natural gas and/or the amount of electricity needed. However, some embodiments may utilize dual-fuel electrical generators without the use of a gas turbine electrical generator and vice versa.

A third portion of the natural gas as a natural gas feed 32 is supplied to a pyrolysis chamber or reactor system 50 that consumes the produced natural gas ($CH_4$) and produces solid carbon (C) and hydrogen gas ($H_2$). For example, a first (upper) zone of the pyrolysis chamber 50 may use electricity to superheat the produced natural gas in a flameless manner in the absence of oxygen so that there are no oxidation reactions within the system. In a second (middle) zone of the pyrolysis chamber, the heat breaks the bonds between the carbon and hydrogen atoms in the natural gas molecules. In a third (lower) zone, the carbon atoms are allowed to cluster together to form various grades of solid carbon, such as carbon black. In the fourth zone, the solid carbon and hydrogen gas exit the pyrolysis chamber and a filter 52 (separation system) separates and transports the solid carbon into a carbon storage container 54 and directs the hydrogen gas to a hydrogen storage vessel 56. Accordingly, a solid carbon product and a hydrogen gas product may be produced from the natural gas.

Figure 4:
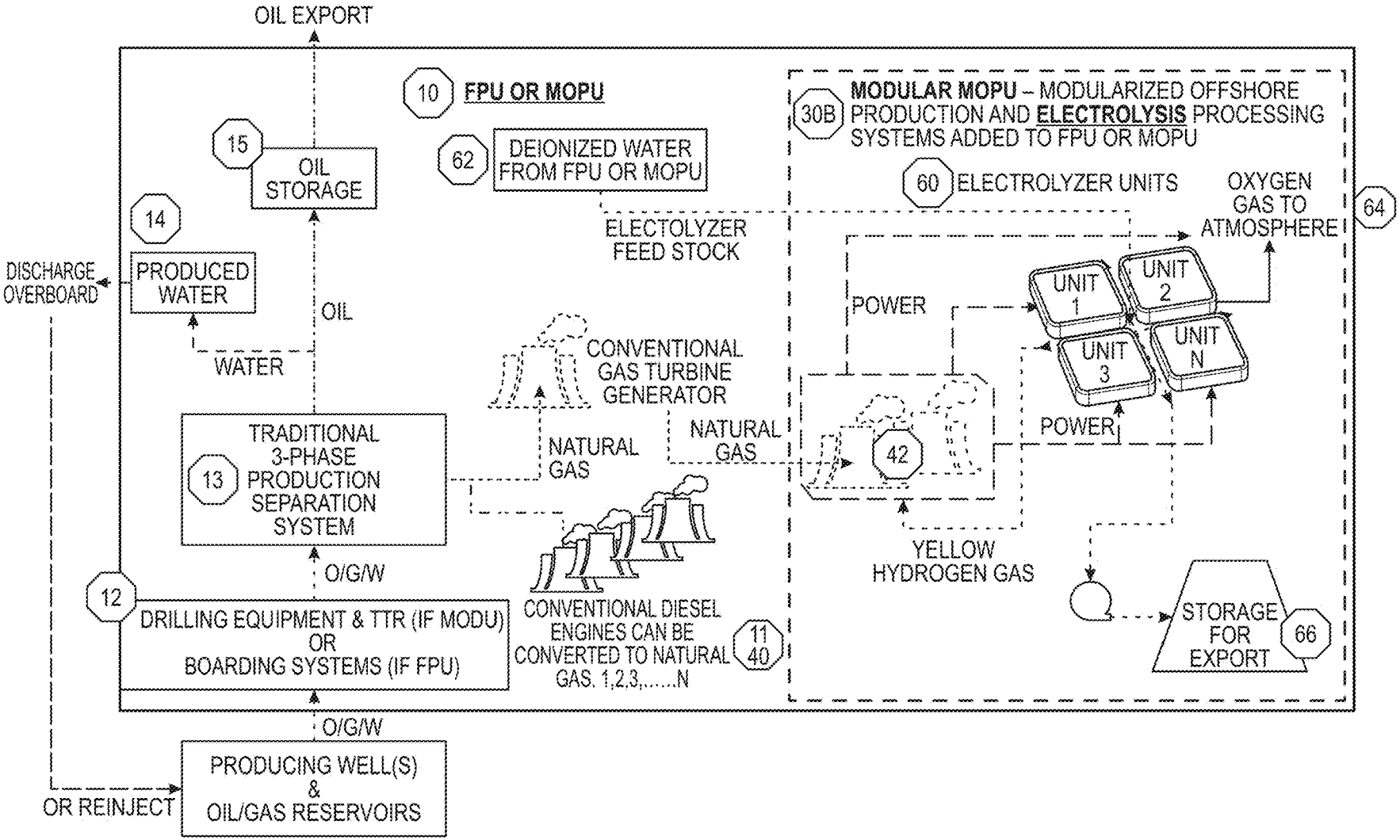
FIG. 4 is a block diagram of a Modular MOPU according to a second embodiment whereby additional power is added for an electrolysis process that produces hydrogen and oxygen gas.

FIG. 4 is a block diagram of a Modular MOPU 30B according to a second embodiment. The Modular MOPU 30B and the FPU or MOPU generates electricity via combustion of the produced natural gas in the dual-fuel electrical generators 40 and/or the additional gas turbine electrical generator 42. The electrical output of these one or more electrical generators is then provided to support the operation of one or more electrolyzer units, such as proton exchange membrane (PEM) electrolyzer units 60.

A source of high-quality liquid water, such as deionized water 62 from the FPU or MOPU, is supplied to the one or more electrolyzers 60. The electrolyzers 60 use electrical current to convert the water ($H_2O$) into hydrogen gas ($H_2$) (at the cathodes) and oxygen gas ($O_2$) (at the anodes) using some or all of the generated electricity. The electrolyzer system 60 may include any number of proton exchange membrane (PEM) electrolyzers. The oxygen gas 64 may be consumed in some local process, produced as a product, or merely discharged into the air. The hydrogen gas is preferably transferred into hydrogen storage 66, such as one or more compressed hydrogen gas or liquid tanks. However, the hydrogen gas could alternatively be input to a gas turbine as an alternative fuel or flared with no formation of $CO_2$, CO, or $NO_x$ since the hydrogen gas does not contain carbon or nitrogen. Some PEM electrolyzer systems may be provided as a modular system referred to as a "modular hydrogen platform" (MHP). Non-limiting examples of a modular hydrogen platform are available from H-TEC SYSTEMS, now Quest One GmbH, Augsburg, Germany. Another example of a modular hydrogen platform is an Elyzer P-300 system available from Siemens Energy, Munich, Germany.

Figure 5:
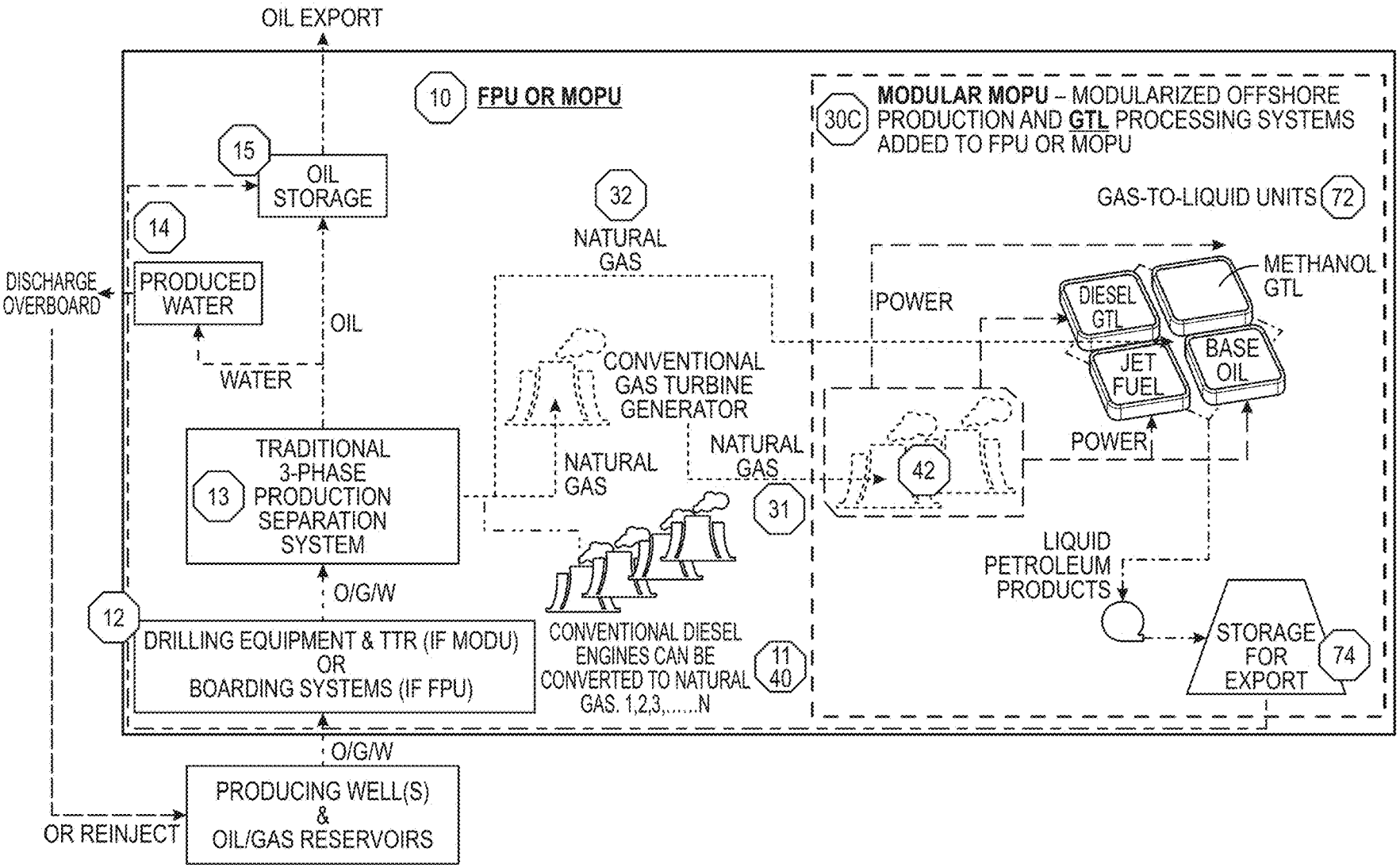
FIG. 5 is a block diagram of a Modular MOPU according to a third embodiment whereby additional power is added for a gas-to-liquids (GTL) process whereby natural gas is converted into one or more environmentally advantaged liquid petroleum products.

FIG. 5 is a block diagram of a Modular MOPU 30C according to a third embodiment. The Modular MOPU 30C and/or the FPU or MOPU generates electricity via combustion of a portion of the produced natural gas in the dual-fuel electrical generators 40 and/or the additional gas turbine electrical generators 42. The natural gas fraction, received from the FPU or MOPU 10 at point 31, is output to the modular offshore production and processing unit (Modular MOPU) 30C for use in the additional gas turbine electrical generators 42 The electrical output of these one or more electrical generators is then provided to support the operation of one or more downstream processes, such as a gas-to-liquids (GTL) unit 72. A direct natural gas feed 32 can provide a natural gas supply directly to the GTL units 72. Optionally, the products from the GTL units may be stored on the Modular MOPU in special storage tanks 74 for export or stored in diesel fuel tanks for consumption.

Figure 6:
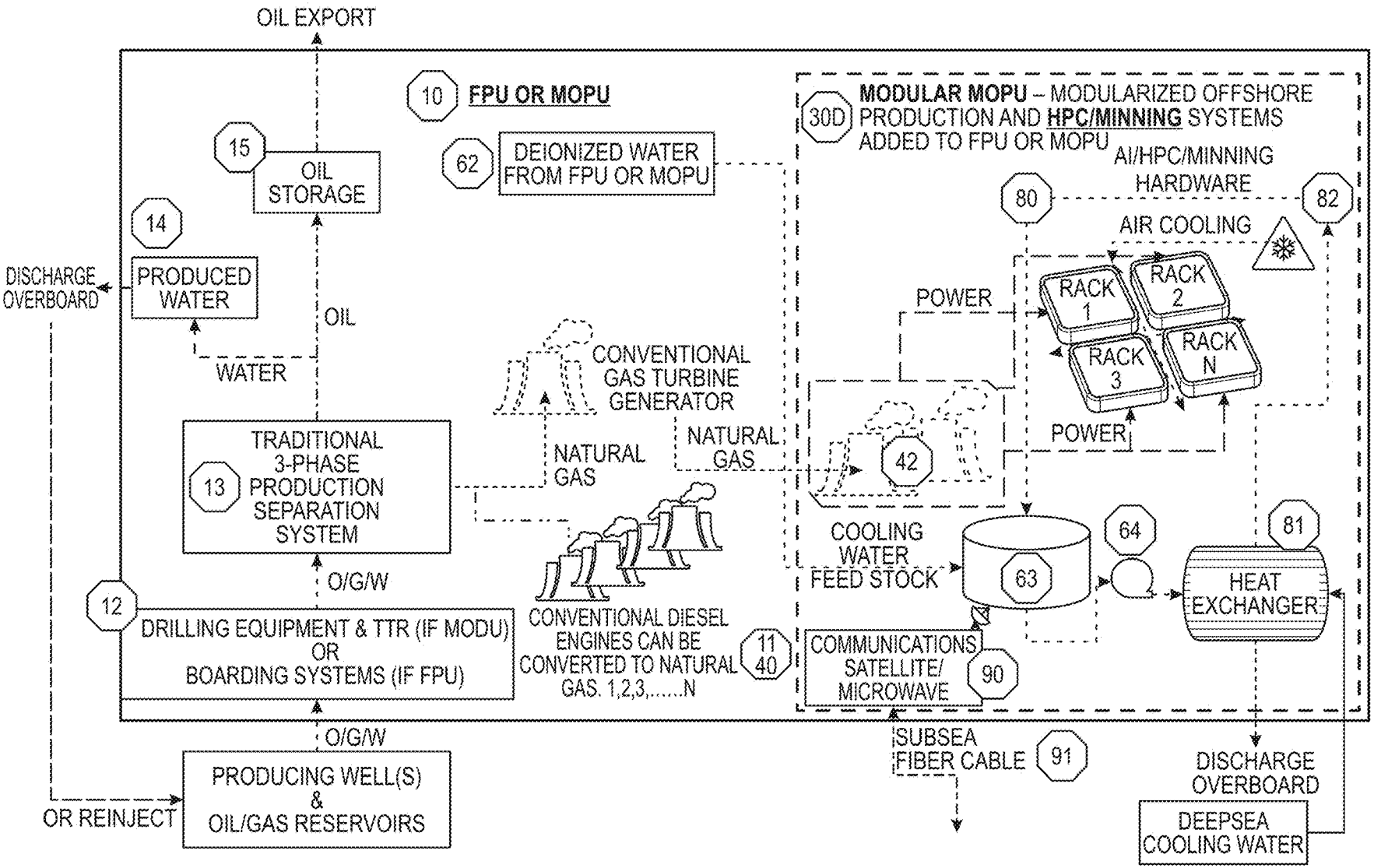
FIG. 6 is a block diagram of Modular MOPU according to the fourth embodiment whereby additional power is added for AI/PC/Mining operations to be collocated on the MOPU during production operations.

FIG. 6 is a block diagram of a Modular MOPU 30D according to a fourth embodiment. The Modular MOPU 30D and the FPU or MOPU generates electricity via combustion of the produced natural gas in the diesel or dual-fuel electrical generators 40 and/or the additional conventional gas turbine electrical generators 42 also capable of duel fuel operations. The electrical output of these one or more electrical generators is then provided to support the operation of multiple AI, HPC or Mining Racks equipped with CPUs, GPUs, TPUs, ASICs and accelerators required for the digital platform being operated.

A source of high-quality liquid water, such as deionized water 62 from the FPU or MOPU, is supplied as makeup cooling/boiler water into tank 63. Water from tank 63 is circulated into heat exchanger 81 and is cooled by ~40° F. seawater, then is circulated for direct AI/HPC/Mining hardware cooling and/or into an air cooler 82 with sufficient capacity to provide cooling for AI/HPC/Mining activities 80 and the living quarters on the facility. Water from tank 63 may also be used to generate steam for production processes and power. Cooling/Boiler water is recovered and reused while deep ocean water is circulated from near the sea floor, through the heat exchanger and then discharged overboard near the surface.

Redundant power sources for operations exist with primary power generated by the gas turbine generators 42, then diesel generators 11 which may be converted to burn natural gas as dual-fuel generators 40, and potentially battery backup if desired. Power generated is distributed in order of importance such as station keeping, safety systems, well operations, compute and cooling and then auxiliary systems.

Communication requirements will be dependent on the type of computing activities installed; however high bandwidth operations will likely require fiber optic cable 91 with satellite backup. Satellite can be a direct installation, or it may be an infrastructure link (tower-to-tower and/or satellite linkages) with high capacity and line-of-sight focus 90. Subsea fiber optic cables 91 are also possible with the type of system and backup dependent on transmission requirements, cost, schedule and redundancy needs.

The terminology used herein is for the purpose of describing particular embodiments only and is not intended to limit the scope of the claims. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition, or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but they are not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

We claim:

1. A modular offshore production and processing system (Modular MOPU), comprising: a floating or bottom-founded platform; a 3-phase separation unit for oil, gas, and water; a modular pyrolysis reactor configured to convert natural gas into hydrogen and solid carbon; a modular electrolyzer system configured to convert water into hydrogen and oxygen using onboard-generated electricity; a gas-to-liquids (GTL) unit configured to convert natural gas into liquid petroleum products; a provisioned zone configured for high-performance computing (HPC) or data mining operations utilizing onsite power and cooling; one or more diesel or dual-fuel generators and additional gas turbine generators configured to consume natural gas and/or hydrogen for power generation; and a control system configured to optimize power distribution and product output.

2. The system of claim 1 wherein the platform is a Modular MOPU, a converted mobile offshore drilling unit (MODU), or floating production unit (FPU).

3. The system of claim 1 wherein the modular components are configured for temporary or permanent installation.

4. The system of claim 1, wherein the hydrogen and carbon products can be stored onboard in dedicated tanks or bulk systems.

5. The system of claim 1, wherein said system includes a pyrolysis reactor device(s) configured for offshore use, comprising: a multi-zone chamber configured to thermally decompose methane in an absence of oxygen; a heating system powered by onboard electricity; a filtration system configured to separate solid carbon from hydrogen gas; a carbon storage unit and a hydrogen system configured for onsite fuel or compression with storage.

6. The system of claim 1, wherein said system includes an electrolyzer unit(s), configured for offshore use and comprised of one or more designs: such as a proton exchange membrane (PEM) stack; a water purification system configured to supply deionized water; a power interface configured to receive alternating or direct current from onboard generators; a hydrogen storage tank and an oxygen discharge system.

7. The system of claim 1, wherein said system includes a gas-to-liquids (GTL) conversion unit, configured for offshore use and comprising: a feedstock conditioning module; a catalytic reactor configured to convert methane into one or more liquid petroleum products such as diesel, methanol, or jet fuel; a heat source powered by onboard combustion or electricity; a liquid product storage system wherein an electrolyzer unit also provides oxygen for said GTL process and production of hydrogen.

* * * * *